US006079491A

United States Patent [19]

Stuebinger et al.

[11] Patent Number: 6,079,491

[45] **Date of Patent: *Jun. 27, 2000**

[54] DUAL INJECTION AND LIFTING SYSTEM USING A ROD DRIVEN PROGRESSIVE CAVITY PUMP AND AN ELECTRICAL SUBMERSIBLE PROGRESSIVE CAVITY PUMP

[75] Inventors: Lon A. Stuebinger, Littleton, Colo.; Howard L. McKinzie, Sugar Land, Tex.

[73] Assignee: Texaco Inc., White Plains, N.Y.

[ * ] Notice: This patent is subject to a terminal disclaimer.

[21] Appl. No.: 09/154,142

[22] Filed: Sep. 17, 1998

Related U.S. Application Data

[60] Provisional application No. 60/059,734, Sep. 23, 1997.

[51] Int. Cl.[7] ..... E21B 43/40

[52] U.S. Cl. ..... 166/266; 166/369; 166/68.5

[58] Field of Search ..... 166/265, 266, 166/369, 106, 65.1, 68.5; 210/170, 747, 538, 540

[56] References Cited

U.S. PATENT DOCUMENTS

| | | | |
|---|---|---|---|
| 2,281,801 | 5/1942 | Reynolds et al. . | |
| 2,910,002 | 10/1959 | Morgan . | |
| 4,241,787 | 12/1980 | Price . | |
| 4,251,191 | 2/1981 | Gass et al. . | |
| 4,295,795 | 10/1981 | Gass et al. . | |
| 4,296,810 | 10/1981 | Price . | |
| 4,793,408 | 12/1988 | Miffre . | |
| 5,224,837 | 7/1993 | Lamphere et al. | 417/63 |
| 5,657,821 | 8/1997 | Beauquin et al. | 166/68 |

FOREIGN PATENT DOCUMENTS

| | | |
|---|---|---|
| 2 194 572 | 3/1988 | United Kingdom . |
| 2 248 462 | 4/1992 | United Kingdom . |
| WO 97/25150 | 7/1997 | WIPO . |

*Primary Examiner*—William Neuder
*Assistant Examiner*—Zakiya Walker
*Attorney, Agent, or Firm*—Harold J. Delhommer; Howrey & Simon

[57] ABSTRACT

The present invention relates to an apparatus and method for selectively lifting produced fluids, including produced hydrocarbons and a portion of produced water, to a ground surface while injecting the remaining produced water into an injection zone subsurface in a subterranean well. The invention preferably utilizes a rod-driven progressive cavity pump (RD-PCP) in conjunction with an electrical submersible progressive cavity pump (ESPCP) in order to carry out the dual injection and lifting steps. Further, this apparatus and method make it possible to produce hydrocarbons from oil wells in a manner that poses less risk and disturbance to the environment.

44 Claims, 5 Drawing Sheets

DUAL INJECTION AND LIFTING SYSTEM USING A ROD DRIVEN PROGRESSIVE CAVITY PUMP AND AN ELECTRICAL SUBMERSIBLE PROGRESSIVE CAVITY PUMP

The present application claims priority under 35 U.S.C. § 119(e) to provisional application 60/059,734, filed Sep. 23, 1997, the entirety of which is incorporated herein by reference.

BACKGROUND OF THE INVENTION

1. Field of the Invention

The present invention relates to an apparatus and method for improving the economics of hydrocarbon production from a producing well. In particular, the present invention relates to an apparatus and method for selectively lifting produced fluid, including produced hydrocarbons and a portion of produced water, to the ground surface and for injecting the remaining produced water, subsurface, in a subterranean well.

2. Related Art

Conventional hydrocarbon production wells have been constructed in subterranean strata that yield both hydrocarbons, such as oil and gas, and an undesired amount of water. These wells are usually lined with heavy steel pipe called "casing" which is cemented in place so that fluids cannot escape or flow along the space between the casing and the well bore wall. In some wells, large amounts of water are produced along with the hydrocarbons from the onset of production. Alternatively, in other wells, relatively large amounts of water can be produced later during the life of the well.

The production of excess water to the ground surface results in associated costs in both the energy to lift, or "produce," as well as the subsequent handling of the excess produced water after it has arrived at the surface. Moreover, the produced water must be disposed of after it has been brought to the ground surface. Surface handling of excess water, in addition, creates risks of environmental pollution from such incidents as broken lines, spills, overflow of tanks, and other occurrences. Further, the facilities, lines and wells required to handle excess water disturb the environment by virtue of their construction and presence. Accordingly, many oil production fields and wells often rapidly become uneconomic to produce because of excessive water production.

Various apparatuses and methods have been proposed to overcome the problems associated with excess water production and the aforementioned problems associated with lifting, or producing, this water to the ground surface. Several approaches have been used to produce excess water to the ground surface or to avoid producing the excess water to the ground surface by shutting off the water at the entry into the wellbore. Among these means are: installing larger pumps to pump the water to the ground surface; shutting off the water by injecting gels or resins into the formation; and installing mechanical means in the well to interrupt the flow of water into the wellbore. These approaches, however, have not recognized that effective removal of water from oil or gas wells can be accomplished by transferring the accumulated water subsurface to a water-absorbing injection formation.

An evolving approach to the problem of excess water production is to take advantage of the downhole gravity segregation of produced hydrocarbons and produced water in the wellbore. The excess produced water is then conveyed into an injection formation of the subterranean strata while, for example, the oil and a small portion of the produced water that has not fully segregated from the oil are produced, or "lifted," to the ground surface. Such an approach has generally been referred to as an "in-situ" injection method. The conveyance downhole of produced water, without having lifted a majority or all of it to the ground surface, can substantially improve lease revenues or reduce lease operation expenses and investments, thereby extending the economic life of entire fields.

Devices or systems that lift and/or flow hydrocarbons and a portion of the water to the ground surface, while simultaneously injecting the water which has been separated downhole may be referred to by those persons having ordinary skill in the art as "Dual Injection and Lifting Systems (DIALS)," or alternatively, as "Downhole Oil Water Separation (DOWS)."

Generally, such methods have required the availability of a suitable injection formation, either below or above the production zone, with sufficient permeability to permit injection of the excess water into the injection formation. In addition, these in-situ methods have generally employed pumps of the same type (e.g., dual rod pumps). These pump combinations have generally been powered by the same prime mover or drive, such as a conventional pump drive located at the ground surface.

Conventional coupled systems which have been driven by the same prime mover have presented numerous problems with regard to production flexibility in order to accommodate changing reservoir conditions. This is so because it has not been feasible or simple enough to individually control the amount of fluids being lifted to the ground surface and the amount of water being injected by the coupled pumps. For example, the output of the lifting pump in a coupled system, such as a dual-rod pump, may not be variably reduced during production and the output of the injection pump may not be variably increased during production. Such flexibility is needed, for instance, when the well volume remains constant during production but the percentage of oil production decreases with time.

One example of a conventional production apparatus of the coupled in-situ type is a Dual Action Pumping System ("DAPS") that produces oil and a portion of the water from a casing/tubing annulus on the upstroke of the pump, injects water on the downstroke, and uses the gravity segregation of the oil and water within the annulus. Such an apparatus is shown in U.S. Pat. No. 5,497,832, also assigned to the assignee of the present application, the entirety of which is incorporated herein by reference.

Tests of this technology in a number of different wells have shown that gravity segregation of oil and water enable a dual-ported, dual-plunger rod pump to selectively lift produced fluids, including produced hydrocarbons and a portion of produced water, while separating and injecting the remaining produced water into an injection zone within the subterranean strata.

The DAPS apparatus, however, does not solve all of the problems associated with excess water production or changing water production within the subterranean reservoir. Very often, the use of two pumps of the same type (e.g., dual rod pumps) may limit the ability of the pumping system to minimize the amount of water lifted to the ground surface. For example, a system, such as DAPS, using a 1.75" diameter rod pump and a 1.5" diameter rod pump will generally lift approximately 18% of the total produced fluids to the ground surface even though the well produces only approximately 5% oil. Further, in coupled systems (i.e., pumps sharing the same prime mover), as noted above, the ability of the systems to adjust to changing water cut production is limited. For example, the various parts of the pump assemblies of coupled systems cannot economically be changed frequently enough to meet changing reservoir conditions.

In a further example of the conventional in-situ approach, coupled rod pumps are used for separating and producing oil from water in a well, while simultaneously injecting the water into the producing formation or into an injection formation below the producing formation. Such an apparatus is shown in U.S. Pat. No. 5,697,448. The apparatus employs three spaced packers (upper, middle, and lower). An oil pump is located between the upper and middle packers, and a water pump is located between the middle and lower packers. Produced oil and water are accumulated between the upper and middle packers. The oil is delivered through an opening into the oil pump and fills a cylinder associated with the oil pump. Produced water is allowed to drain through additional passages into the water pump cylinder where it accumulates for injection. Selective pumping of the oil on the upstroke of the pump and the water on the downstroke of the pump is effected by a set of check valves associated with both the oil and water pumps. Such an apparatus, how ever, is not an optimal solution to the problems associated with changing water and oil production presented by conventional coupled systems. For example, the apparatus does not provide the flexibility needed to vary the percentage of total reservoir output that is lifted or brought to the ground surface without substantial modifications to the system.

In another example of an in-situ type apparatus, a formation injection tool, mounted to a bottom-hole tubing pump, carries out underground separation and down-bore in-situ transport and injection of the undesired fluids into an injection formation in the production well. Such an apparatus is shown in U.S. Pat. No. 5,425,416. As with the apparatus shown in U.S. Pat. No. 5,697,448, this system does not provide the flexibility needed to quickly and inexpensively change the proportion of fluids lifted to the ground surface as conditions within the subterranean producing strata change.

Moreover, conventional systems such as those described above have failed to provide a simple and effective method for handling high viscosity oils or solids, such as sand, which are present in many production wells. In addition, many wells have become inoperative due to the inability of conventional systems to handle crude oil and gas mixtures or shear sensitive fluids. Conventional wells generally have also not been able to compensate for changes in pressure, such as those that may be caused by gas bubbles.

Thus, there is a need in the art for an apparatus and method that substantially obviates one or more of the limitations and disadvantages of conventional pumping systems. Particularly, there is a need for a system for lifting produced oil and a portion of the produced water to the ground surface, while injecting the remainder of the produced water into an injection formation. There is a particular need for uncoupled systems which have the flexibility to vary the proportions of fluids lifted to the ground surface to the amount of water injected subsurface within the subterranean strata. There is also a need for such systems to be able to handle a variety of conditions within the producing reservoir.

SUMMARY OF THE INVENTION

The present invention solves the problems with, and overcomes the disadvantages of, conventional coupled systems for lifting produced hydrocarbons and a portion of the produced water to the ground surface following gravity segregation, and for injecting, without lifting to the ground surface, the remaining produced water into an injection zone.

The present invention relates to an apparatus for selectively lifting produced fluids, including produced hydrocarbons and a portion of produced water, to a ground surface and injecting, without lifting to the ground surface, the remaining produced water below the ground surface. The apparatus includes a casing having two spaced intervals. The casing extends from the ground surface downwardly such that a first of the two spaced intervals communicates with a producing zone and a second of the two spaced intervals communicates with an injection zone.

The apparatus further includes a rod-driven progressive cavity pump and an electrical submersible progressive cavity pump disposed in the casing. A packer is also included. The packer is disposed within the casing between the first of the two spaced intervals and the second of the two spaced intervals. The casing and the packer are configured to permit the produced fluids to collect above the packer whereby the produced hydrocarbons and produced water segregate by gravity.

The apparatus also includes a first inlet for permitting the segregated produced hydrocarbons and portion of the produced water to enter one of the rod-driven progressive cavity pump and the electrical submersible progressive cavity pump. A second inlet is included for permitting the segregated produced water to enter the other of the rod-driven progressive cavity pump and the electrical submersible progressive cavity pump.

In a further aspect of the invention, a downhole oil and water separation system is provided for conducting produced fluids, including produced hydrocarbons and a portion of produced water, to a ground surface and injecting, without conducting to the ground surface, the remaining produced water below the ground surface. The system includes a casing having two spaced intervals. The casing extends from the ground surface downwardly such that a first of the two spaced intervals communicates with a producing zone and a second of the two spaced intervals communicates with an injection zone.

The system further includes a rod-driven progressive cavity pump and an electrical submersible progressive cavity pump disposed in the casing. The rod-driven progressive cavity pump is not drivingly coupled to the electrical submersible progressive cavity pump. A packer is disposed within the casing between the first of the two spaced intervals and the second of the two spaced intervals. The casing and the packer are configured to permit the produced fluids to collect above the packer whereby the produced hydrocarbons and produced water segregate by gravity.

In one aspect of the system, a first inlet permits segregated produced hydrocarbons and portion of the produced water to enter the rod-driven progressive cavity pump, and a second inlet permits the segregated produced water to enter the electrical submersible progressive cavity pump.

In an alternate aspect of the system, the first inlet permits segregated produced hydrocarbons and portion of the produced water to enter the electrical submersible progressive cavity pump, and the second inlet permits the segregated produced water to enter the rod-driven progressive cavity pump.

In another aspect, the present invention relates to a method for selectively lifting fluids, including produced hydrocarbons and a portion of produced water from a subterranean well, to a ground surface and injecting, without lifting to the ground surface, the remaining produced water, subsurface, the subterranean well traversing a producing zone and an injection zone.

The method includes allowing produced water and produced hydrocarbons to collect and to segregate above a packer disposed in a casing in the subterranean well. In addition, the method includes controlling one of a rod-driven progressive cavity pump and electrical submersible progressive cavity pump to lift the segregated produced hydrocarbons and portion of the produced water to the ground surface. The method also includes independently controlling the other of the rod-driven progressive cavity pump and electrical submersible progressive cavity pump to inject the segregated produced water into the injection zone.

Features and Advantages

The present invention represents a different approach to the aforementioned problems of conventional coupled systems. The present invention represents an improvement over such systems, particularly when used in loosely consolidated formations where solids production can be a problem, or where gas and condensate production accompanies the crude oil production.

The present invention also provides for uncoupled pump systems that are separately and independently controlled by, and driven by, individual drive units which provide a simple, expedient, and flexible method for controlling the amount of hydrocarbons and water lifted to the ground surface, while at the same time injecting excess produced water into an injection zone. The present invention provides such flexibility while retaining the advantages of surface rod-driven progressive cavity pumps and electrical submersible progressive cavity pumps.

The present invention also is advantageous over purely rod-driven lift systems because it can handle larger volumes of produced fluids. Moreover, the rates for lifting hydrocarbons to the ground surface and for injecting water into a disposal zone may be separately and independently varied and controlled.

The present invention may also be used in oil-producing wells to reduce lease costs that are directly associated with the volume of the total produced fluids lifted and handled at the ground surface from a producing well. A reduction in the volume of produced fluids lifted to and handled at the ground surface results in a lowering of the horsepower required to operate the well since only produced hydrocarbons and a small fraction of produced water are actually lifted to the ground surface. Similarly, water injection costs, water treatment costs, spill containment costs, water transportation costs, and environmental cleanup costs may be substantially reduced by use of the present invention.

The present invention may also increase revenues from oil-producing wells. Use of dual injection and lifting systems such as the present invention, as opposed to use of conventional lift systems which produce all fluids to surface, can increase production rates of producing wells. This increases operating revenues which can lead to an extended economic life of the well. Moreover, wells which previously were not operating due to high water volumes may be returned to production.

The present invention may also reduce investment costs for surface equipment. Moreover, separation equipment, treating equipment, and filtration equipment may be eliminated or reduced in size.

The present invention may also reduce exposure of the environment to damage from oil-producing operations. Potential environmental damages may be lessened by minimizing the amount of water produced to, and handled at, the surface. As known in the art, such surface water must then be reinjected into the subterranean strata through separate wellbores, or "injection wells." The very act of constructing facilities or drilling injection wells disturbs the natural environment.

The present invention also provides a simple and effective method for handling high viscosity oils or solids, such as sand, which are present in many production wells. In addition, many wells which have become inoperative due to the inability of conventional systems to handle crude oil and gas mixtures or shear sensitive fluids may be returned to production. The present invention also allows compensation for changes in pressure, such as those that may be caused by gas bubbles.

Additional features and advantages of the invention will be set forth in the description that follows, and in part will be apparent from the description, or may be learned in practice of the invention. These descriptions and drawings are intended as illustrative of the invention, and not as limitative thereof.

BRIEF DESCRIPTION OF THE DRAWINGS

The accompanying drawings, which are incorporated in a nd constitute a part of this specification, illustrate embodiments of the invention and, together with the description, serve to explain the features, advantages, and principles of the invention.

DETAILED DESCRIPTION OF THE PREFERRED EMBODIMENTS

Reference will now be made in detail to the present preferred embodiments of the invention, examples of which are illustrated in the accompanying drawings. The exemplary embodiments of this invention are shown in some detail, although it will be apparent to those skilled in the relevant art that some features which are not relevant to the invention may not be shown for the sake of clarity.

Figure 1:
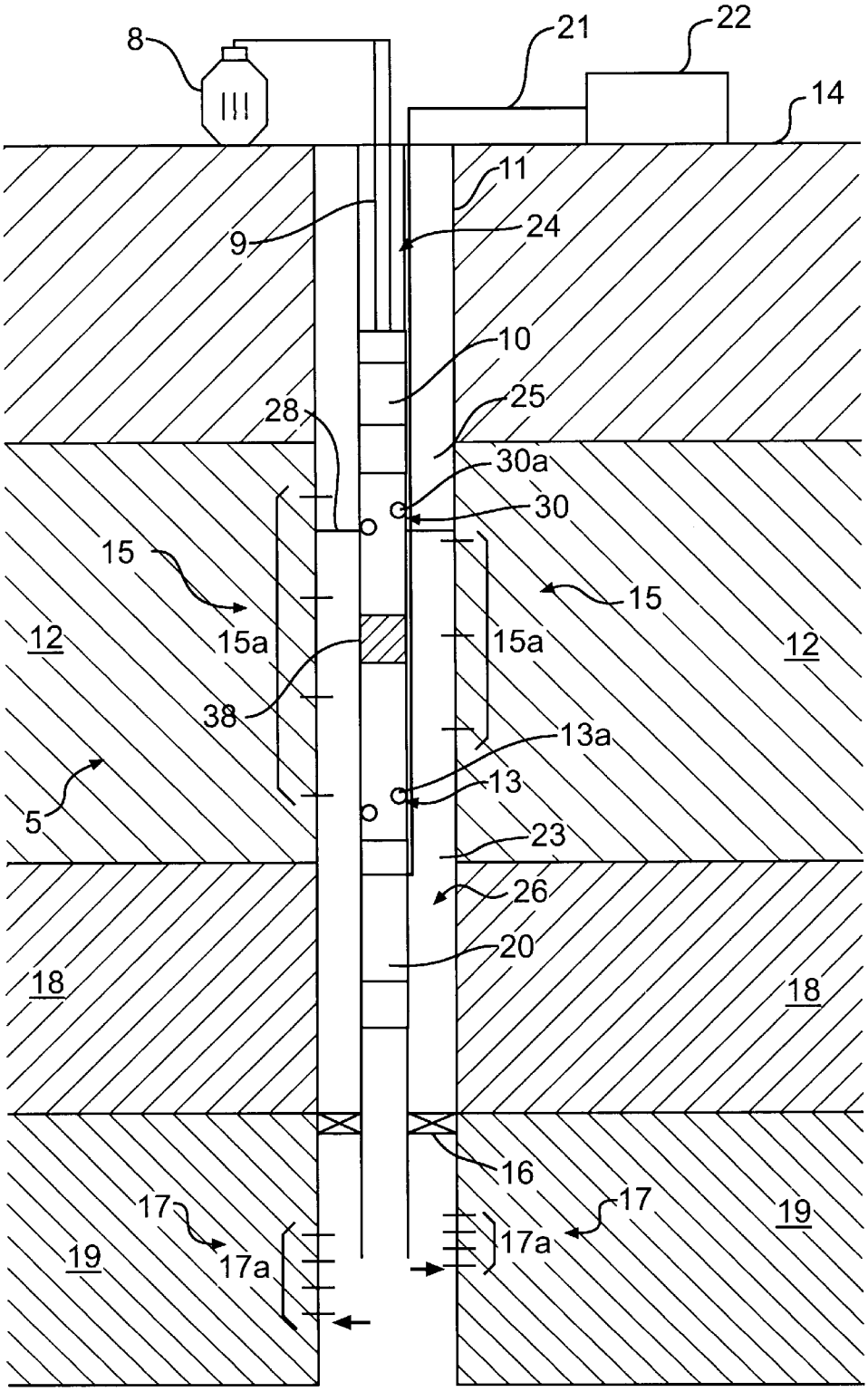
FIG. 1 is a schematic side-elevation sectional view of an embodiment of the present invention.

Referring first to FIG. 1, there is illustrated, in a schematic side-elevation sectional view, an exemplary embodiment of the present invention and is represented generally by reference numeral 5. A casing 11 is shown extending from a ground surface 14 downwardly within a subterranean well through a hydrocarbon and water producing or production zone 12 and then to a water injection zone 19. It should be understood by one of ordinary skill in the art that injection zone 19 may alternatively be referred to as a disposal zone. It is preferable to have a long distance or an isolation zone 18 between producing zone 12 and injection zone 19.

As shown in FIG. 1, casing 11 has a producing interval, shown generally at 15, separated from an injection interval, shown generally at 17. Producing interval 15 is located adjacent to and in fluid flow communication with producing zone 12. In a similar manner, injection interval 17 is located adjacent to and in fluid flow communication with disposal, or injection zone 19. Producing interval 15 may preferably be for example, but is not limited to, perforations 15*a* with or without gravel packs in casing 11 as shown in FIG. 1. Alternatively, producing interval 15 may be, but is not limited to, a slotted liner with or without gravel packs, wire-wrapped screens with or without gravel packs, or pre-packed wire-wrapped screens. Likewise, injection interval 17 may preferably be, but is not limited to, perforations 17*a* with or without gravel packs in casing 11 as shown in FIG. 1. As an alternative, injection interval 17 may be a slotted liner with or without gravel packs, wire-wrapped screens with or without gravel packs, or pre-packed wire-wrapped screens. As a further alternative, instead of using injection interval 17, the excess water may be injected directly into an open hole (not shown) within the subterranean strata. Preferably, however, injection interval 17 will be perforations 17*a*.

It should be readily apparent to one skilled in the art that casing 11 may be provided with multiple producing intervals 15 and injection intervals 17 in communication with producing zone 12 and injection zone 19, respectively. Moreover, injection zone 19 can be the same formation as producing zone 12 provided that producing interval 15 and injection interval 17 are not communicating actively (i.e., fluid flow is isolated between producing interval 15 and injection interval 17). It should be understood by those of skill in the art, however, that fluids produced into casing 11 through producing interval 15 and water injected through injection interval 17 may influence the flow parameters of each other.

Casing 11 surrounds a tubing 24 which extends from ground surface 14 downwardly within casing 11. A first pump 10 is disposed in tubing 24 and a second pump 20 may be disposed in a lower end of tubing 24 as shown in FIG. 1. Alternatively, first pump 10 may be coupled to tubing 24 by any suitable method such as threaded connections. In such an embodiment, it should be apparent to one of ordinary skill in the art that tubing 24 would preferably comprise two tubing sections. The first tubing section extends downwardly with casing 11 and is coupled to one end of first pump 10. The second tubing section is coupled to the other end of first pump 10 and extends downwardly within casing 11. Second pump 20, as described above, may be disposed within tubing 24, or more particularly in the second tubing section, below first pump 10. First pump 10 and second pump 20 are uncoupled relative to each other. Particularly, first pump 10 is not drivingly coupled to second pump 20. First pump 10 and second pump 20 are preferably controlled by individual drives as will be described in more detail below. This configuration allows the individual pump rates to be separately controlled to respond to changing reservoir conditions. Moreover, individual rates of lift and injection can be separately controlled to optimize overall field performance. In the embodiment shown in FIG. 1, first pump 10 is a surface rod-driven progressive cavity pump (RD-PCP) and second pump 20 is an electrical submersible progressive cavity pump (ESPCP). Alternately, first pump 10 could be an electrical submersible progressive cavity pump powered by the same or different variable speed drive (as will be described in more detail below) that provides power to second pump 20.

A packer 16 is disposed within casing 11, preferably between producing interval 15 and injection interval 17. Casing 11 and packer 16 are configured to permit produced hydrocarbons and produced water to collect above packer 16. By "produced hydrocarbons" is meant crude oil, gas, gas condensate, and various combinations thereof. Particularly, tubing 24, casing 11, and packer 16, together define casing/tubing annulus 26 that extends upward to ground surface 14. Hydrocarbons, such as oil or gas, and water flow or are "produced," into casing 11 through producing interval 15. The hydrocarbons and water segregate by gravity within casing-tubing annulus 26 forming a hydrocarbon/water interface 28. "Gravity segregation," as used herein, is intended to describe the preservation of the isolation between produced hydrocarbons and water, as opposed to separation which indicates that a mixture is mechanically divided into separate fluids. Thus, the produced hydrocarbons and water are allowed to collect in annulus 26 above packer 16 and to segregate by gravity to form segregated produced water 23 below hydrocarbon/water interface 28, and hydrocarbons and a small portion or proportion of produced water 25 above hydrocarbon/water interface 28.

A first, or upper inlet 30 is preferably disposed in tubing 24 below first pump 10. First inlet 30 is preferably disposed in a region of casing 11, or more particularly, in a region of a casing/tubing annulus 26, where segregated hydrocarbons and only a small amount of water are expected to be present and preferably, adjacent hydrocarbon/water interface 28. As shown in the exemplary embodiment in FIG. 1, first inlet 30 may be sets of perforations 30*a* in tubing 24. Alternatively, first inlet 30 may be a port or multiple ports or other suitable mechanism for conducting fluid flow. Preferably, however, first inlet 30 will be sets of perforations 30*a*. First inlet 30 is configured to permit the produced hydrocarbons and any small portion of water that has not segregated from the hydrocarbons to enter first pump 10. The operation of first inlet 30 will be described in more detail below.

A sucker rod string 9 is also disposed within tubing 24. Rod string 9 extends to ground surface 14 where it is rotated by a motor 8 located at ground surface 14. Preferably, motor 8 is coupled to a drive head (not shown) and rod string 9 is coupled to the drive head in a manner which is well-known to one of ordinary skill in the art. Rod string 9 is coupled to first pump 10. As rod string 9 is rotated by motor 8, first pump 10 likewise is rotated. Detail of this rotation will be described in more detail with reference to FIG. 4.

Second pump 20, as shown in FIG. 1, is disposed in a lower end of tubing 24. A second or lower inlet 13 is shown disposed in tubing 24 above pump 20. Second inlet 13 is preferably disposed in a region of casing 11, or more particularly, in a region of casing/tubing annulus 26, where primarily only the heavier segregated produced water is present (i.e., inlet 13 is in fluid-flow communication primarily with segregated produced water 23). As shown in FIG. 1, second inlet 13 may be sets of perforations 13a in tubing 24. Second inlet 13 is configured to permit the segregated produced water from the production zone 12 to enter second pump 20 which will be described in more detail below.

Preferably, tubing 24 extends below packer 16 in casing 11 to permit segregated produced water 23 to be injected into injection zone 19. A tubing plug 38 may be disposed in tubing 24 between first pump 10 and second pump 20 in order to isolate segregated hydrocarbons and a portion of produced water 25 from segregated produced water 23 within tubing 24.

A variable speed drive 22 may be disposed at ground surface 14 to provide power to and control the pump rate of second pump 20. Variable speed drive 22 is electrically connectable to second pump 20 via an electrical line or cable 21. Likewise as noted above, motor 8 is disposed at ground surface 14 to provide power to and control the pump rate of first pump 10. In an embodiment where first pump 10 is also an electrical submersible progressive cavity pump, variable speed drive 22 can be used to provide power to first pump 10, or a second variable speed drive can be used.

Reference will now be made to the operation of the first exemplary embodiment shown in FIG. 1. In operation, produced fluids (hydrocarbons and water) are produced from production zone 12 via intervals 15 into casing 11 above packer 16, thereby forming a column of produced hydrocarbons and water within casing/tubing annulus 26. The lighter produced fluids (mostly hydrocarbons 25) rise to the top of the column while the heavier fluids (mostly water 23) settle to the bottom of the column.

During rotation of first pump 10, segregated hydrocarbons and a small portion of produced water 25 flow or are "pulled" through first inlet 30 and into tubing 24 below first pump 10. First pump 10 then pumps the segregated hydrocarbons and a small portion of produced water 25 (as will be described in more detail with reference to FIG. 4) through tubing 24 to ground surface 14 where it is collected in a conventional manner. It is preferred that, during production, hydrocarbon/water interface 28 is maintained adjacent first inlet 30 in order to provide stabilized pumping conditions. In order to meet the capacity of first pump 10 and to ensure that hydrocarbon/water interface 28 is maintained adjacent first inlet 30, an upper portion of segregated produced water 23 (in addition to produced hydrocarbons and portion of produced water 25) may be "pulled" by first pump 10 through first inlet 30 and pumped to ground surface 14.

Simultaneously, segregated produced water which has settled at the bottom of casing/tubing annulus 26 flows through second inlet 13 and into second pump 20. The segregated water is then pumped or injected (as will be described in more detail with reference to FIG. 4) through the end of tubing 24 and into casing 11 below packer 16 and thereafter into injection zone 19.

It should be understood by one skilled in the art that first pump 10 and second pump 20 may include sensors (not shown) for flow rate, pressure, and temperature measurement or other types of control information which is transmitted to motor 8 and/or variable speed drive 22. Thus, first pump 10 and second pump 20 are individually and independently controllable to provide maximum flexibility in selecting pump output to optimize reservoir performance and to allow conformance to changing reservoir conditions. Moreover, because first pump 10 and second pump 20 are separately controlled (i.e., first pump 10 is controlled by motor 8 and second pump 20 is controlled by variable speed drive 22), their respective pump output may be separately and independently varied to correspond to the changing reservoir conditions during production.

The entire combination of first pump 10 and second pump 20 may typically be about 30 feet to several hundred feet in length. Moreover, the distance from producing interval 15 to packer 16, percentage of water cut and injection rate, and designed production rate can all be variables in deciding whether it is desirable to place second pump 20 just above packer 16 or higher in the well.

Figure 2:
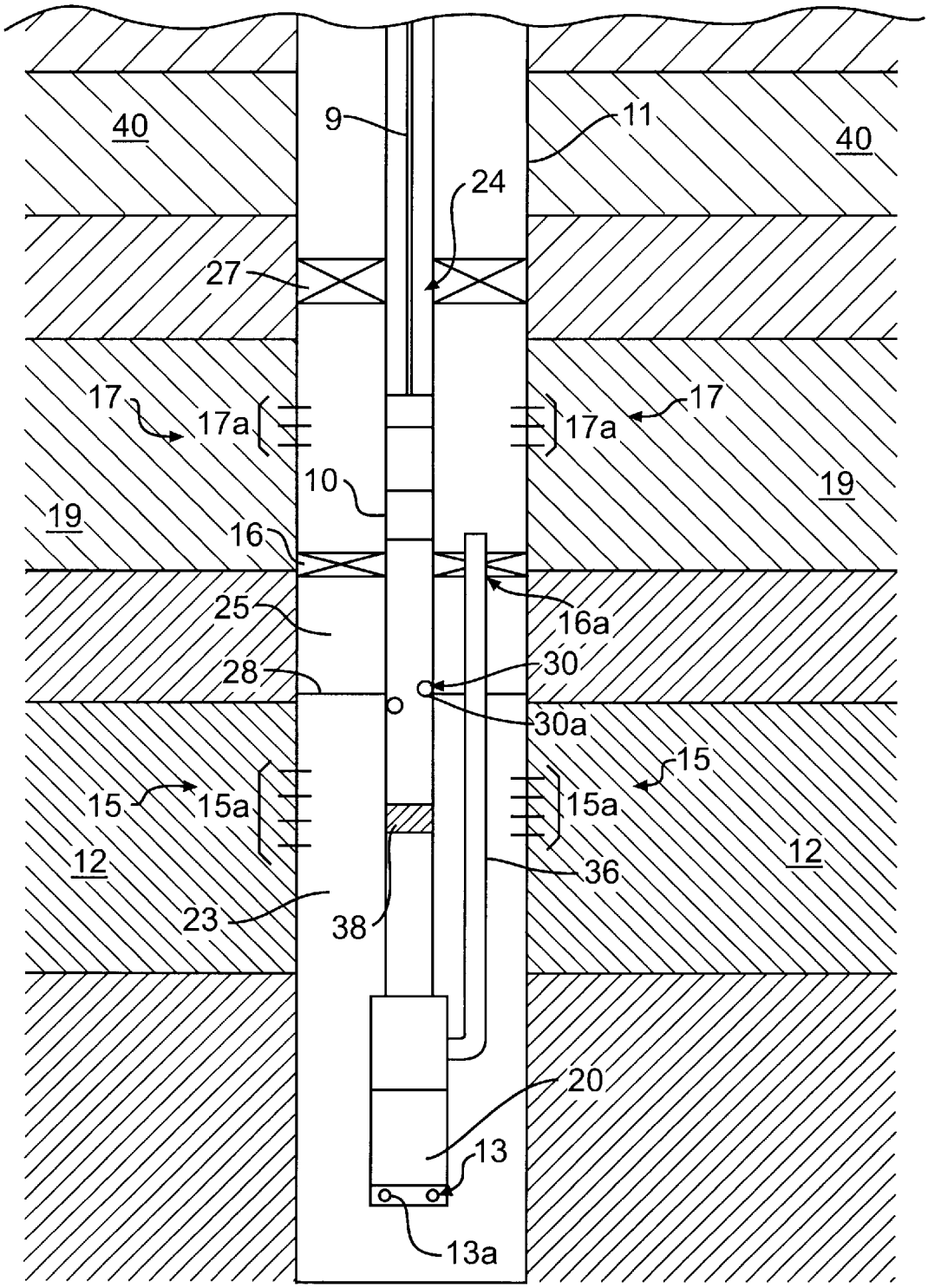
FIG. 2 is a schematic side-elevation sectional view of the embodiment of FIG. 1 employing a bypass conduit for re-injecting produced water into a disposal zone located above a producing zone.

Reference will now be made to FIG. 2, wherein a bypass conduit 36 is shown coupled to second pump 20 for injecting produced water into disposal zone 19 which is located above producing zone 12. As can be seen in FIG. 2, bypass conduit 36 extends up casing/tubing annulus 26 and through a passage 16*a* in packer 16. A second packer 27 is disposed in casing 11 preferably above injection zone 19. Packer 16 and second packer 27 are configured to isolate injection zone 19 within casing 11 from both producing zone 12 and, for example, an isolated aquifer 40. Second inlet 13 is shown disposed on a lower end of second pump 20 such that segregated produced water 23 passing through second pump 20 may be used for cooling purposes.

A tubing plug 38 may be disposed in tubing 24 between first pump 10 and second pump 20 in order to isolate segregated hydrocarbons and a portion of produced water 25 from segregated produced water 23 within tubing 24.

During operation of the system shown in FIG. 2, first pump 10 lifts segregated produced hydrocarbons and a small proportion or portion of produced water 25 to ground surface 14 in the manner described above with reference to FIG. 1. At the same time, second pump 20 pumps segregated produced water 23 that enters second pump 20 through second inlet 13 through bypass conduit 36 and thereafter into disposal zone 19 via injection interval 17.

Figure 3:
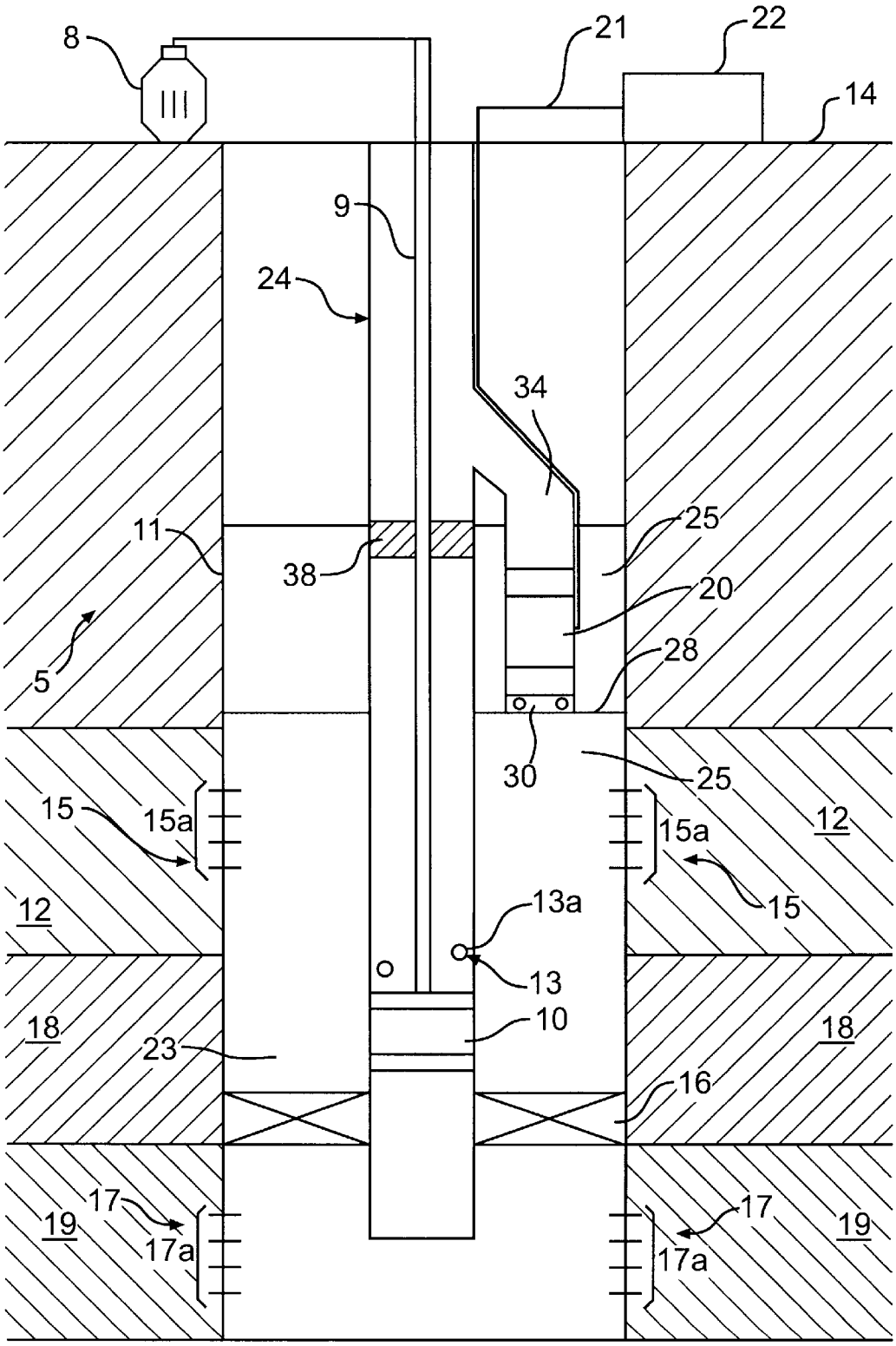
FIG. 3 is a schematic side-elevation sectional view of a second embodiment of the present invention.

Reference will now be made to FIG. 3, wherein a second embodiment of the present invention is shown employing second pump 20 for lifting produced fluids to the ground surface and first pump 10 for re-injecting water. Like reference numerals will be used where appropriate to describe similar elements to those of the embodiment shown in FIG. 1.

In FIG. 3, first pump 10 is shown disposed in tubing 24, which extends below packer 16 in casing 11. Second pump 20 is shown disposed in a branch conduit 34 or what is generally referred to in the art as a "Y-tool". First pump 10 is preferably a surface rod-driven progressive cavity pump. Because first pump 10, or the surface rod-driven progressive cavity pump, is being used to pump in a downward direction, it is preferable to dispose a thrust bearing (not shown) at the top of first pump 10 since the force on the rotor (which will be described in more detail below) is upward. Second pump 20 is preferably an electrical submersible progressive cavity pump. First inlet 30 is disposed in branch conduit 34 below second pump 20 and second inlet 13 is disposed in tubing 24 above first pump 10. The remaining elements shown in FIG. 3 have been described above and for the sake of brevity, such descriptions are herein incorporated by reference.

Reference will now be made to the operation of the second exemplary embodiment shown in FIG. 3. In operation, produced fluids (hydrocarbons and water) are produced from production zone 12 via interval 15 into casing 11 above packer 16 forming a column of produced hydrocarbons and water within casing/tubing annulus 26. The lighter produced fluids (mostly hydrocarbons 25) rise to the top of the column while the heavier fluids (mostly water 23) settle to the bottom of the column.

During rotation of first pump 10, segregated produced water 23 flows through second inlet 13 and into tubing 24 above first pump 10. First pump 10 then forces or injects segregated produced water 23 through the end of tubing 24 below packer 16, into casing 11, and thereafter into injection zone 19. Simultaneously, segregated produced hydrocarbons and a portion of produced water 25 that has not settled to the bottom, flow into first inlet 30 into second pump 20. Second pump 20 pumps the segregated produced hydrocarbons and portion of produced water 25 through Y-tool 34 and tubing 24 to ground surface 14 where it is collected in a well-known manner. Alternatively, the segregated produced hydrocarbons could be produced up casing/tubing annulus 26 to ground surface 14 if sufficient pressure exists in the reservoir.

Tubing plug 38 may be disposed in tubing 24 above first pump 10 and preferably below the intersection of Y-tool 34 and tubing 24 in order to isolate segregated produced hydrocarbons and a portion of produced water 25 from segregated produced water 23 in tubing 24.

Figure 4:
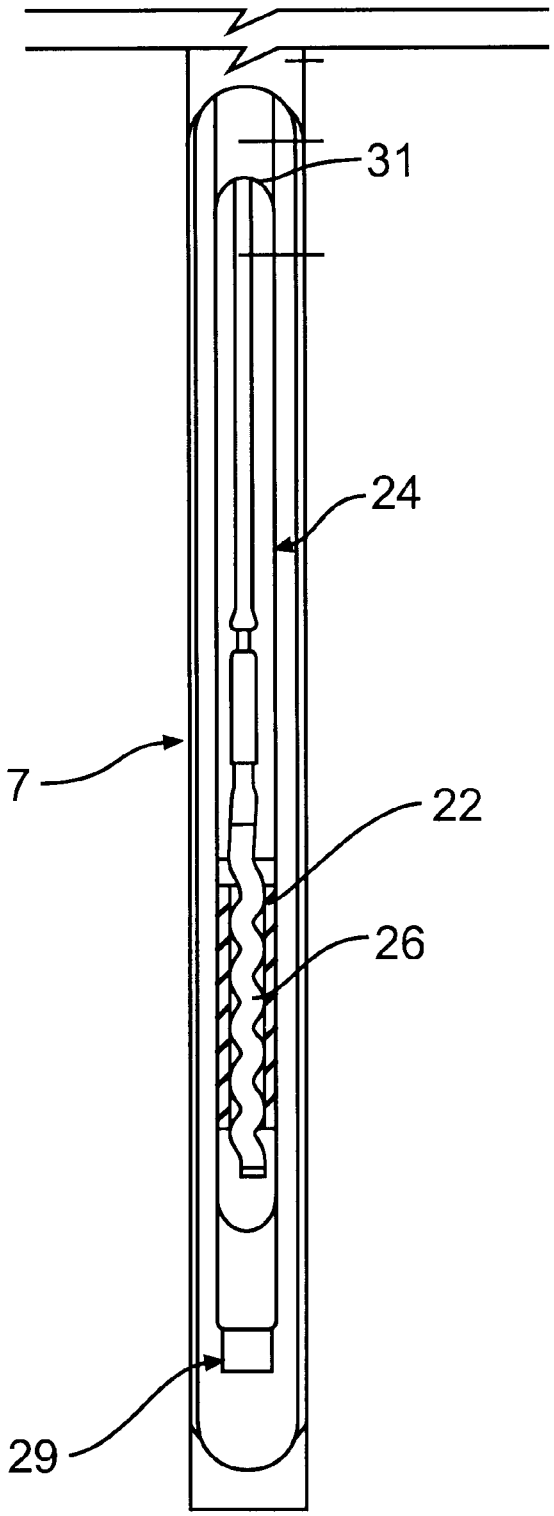
FIG. 4 is a schematic side-elevational view illustrating an exemplary rod-driven progressive cavity pump suitable for use in the present invention.

Reference will now be made to FIG. 4, which is provided to illustrate a schematic partial view of an exemplary progressive cavity pump suitable for use with the present invention, represented generally as reference numeral 7. When used with the present invention, the progressive cavity pump is preferably mounted in tubing 24 as described above.

The progressive cavity pump preferably comprises two components: a helically shaped rotor 26 and a stator 22. Rotor 26, which is the progressive cavity pump's only moving part, is usually in the shape of a single external helix with a round cross section. Rotor 26 is normally plated with a hardened surface coating for abrasion resistance in the presence of sand, formation residue chips, or the like. Stator 22 is generally formed of a very firm, but elastomeric compound (such as synthetic rubber) and usually has a double internal helix. Its external shape is generally cylindrical and therefore provides a surface which may be bonded to a pump body. Rotor 26 is suspended in stator 22 and may be powered by an electrical motor via a gear reduction drive (such as motor 8 disposed at ground surface 14).

Figure 5:
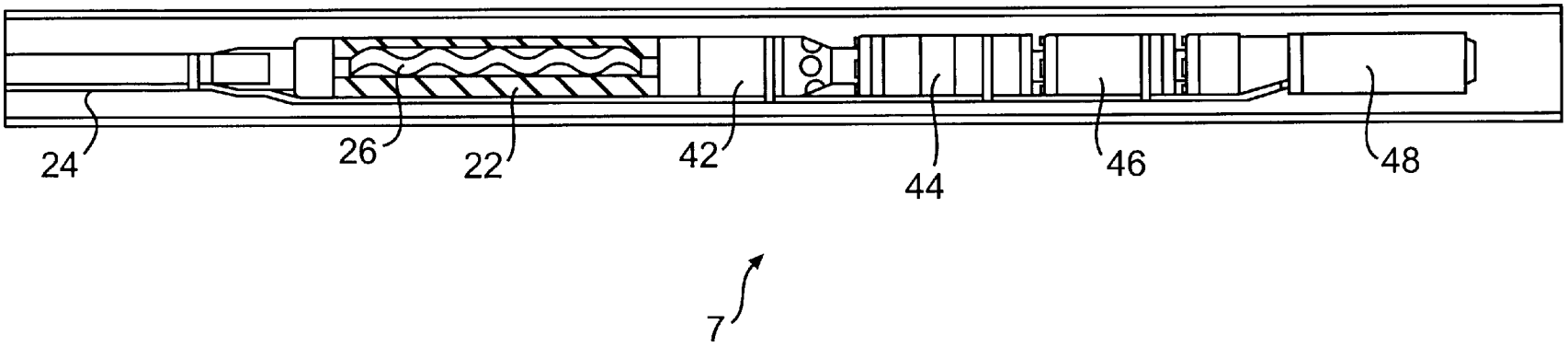
FIG. 5 is a schematic side-elevational view illustrating an exemplary electrical submersible progressive cavity pump suitable for use in the present invention.

Reference will now be made to FIG. 5, which is provided to illustrate a schematic view of an exemplary electrical submersible progressive cavity pump suitable for use with the present invention, represented generally as reference numeral 7. Such an electrical submersible progressive cavity pump is also shown in U.S. Pat. No. 3,677,665, the entirety of which is incorporated herein by reference.

As shown in FIG. 5, the electrical submersible progressive cavity pump 7 comprises a rotor 26 and a stator 22, as described above with reference to FIG. 4. Electrical submersible progressive cavity pump 7 may be coupled to tubing 24 as described above. Pump 7 also preferably includes a flex shaft 42 coupled to stator 22. Flex shaft 42 is coupled to a seal section 44. Likewise, seal section 44 is coupled to a gearbox 46 which, in turn, is coupled to a motor 48. Motor 48 may be electrically coupled to a variable speed drive located at the ground surface as described above. Motor 48 provides rotation to rotor 26 in a conventional manner.

In operation, as internal helical pump rotor 26 is turned, a series of cavities are formed between the helices of rotor 26 and stator 22 beginning at the intake end and progressing, with the rotary motion, to the output end. The progressive cavities cause fluid to be pumped from the input end to the output end. If rotor 26 is chosen to have a right hand pitch helix, then a vertical pump placed in a well will input fluid into its lower end 29 and output fluid from its upper end 31 with right hand rotation. Such an operation, for example, is preferably employed in first pump 10 in the embodiment shown in FIG. 1. Likewise, such an operation is employed in second pump 20 in the embodiment shown in FIG. 3. Conversely, if rotor 26 is chosen to have a left hand pitch helix, then a vertical pump placed in a well will input fluid from its upper end 31 and output the fluid from its lower end 29. Such an operation, for example, is preferably employed in second pump 20 in the embodiment shown in FIG. 1. Likewise, such an operation is employed in first pump 10 in the embodiment shown in FIG. 3.

The progressive cavity pumps are highly efficient when compared to other oil field pumps in common usage. For example, a typical electrical-powered submersible centrifugal pump is from about 25% to 45% efficient. A hydraulic jet pump usually runs from about 15% to 30% efficient. Sucker rod powered mechanical pumps generally run from about 45% to 50% efficient. Conversely, progressive cavity pumps usually run from about 70% to 95% efficient. The progressive cavity pump can also handle solids or very heavy crude oil where more delicate electric pump impellers, electric motors or gearboxes on sucker rod pumping units fail. While a hydraulic jet pump can efficiently operate in high solids environment, its operating efficiency is only about one third of the progressive cavity pump. Progressive cavity pumps that are commercially available can operate at production rates of up to 5200 barrels of fluid per day, at depths up to 10,000 feet, with fluid density from 6 to 45 American Petroleum Institute (API) degrees gravity, at temperatures up to 300° F./150° C. and in salty, sandy and high viscosity fluids.

As described above, the present invention provides a simple method and apparatus for providing flexibility and reliability in lifting produced hydrocarbons and only a portion of the produced water to the ground surface while simultaneously injecting excess produced water subsurface. It should be apparent that the present invention may be used to increase efficiency and production, to lower production, injection, and equipment costs, and to extend the overall commercial life of hydrocarbon producing fields.

Moreover, the present invention significantly reduces the disturbance to and impact on the natural environment, while improving the economics of hydrocarbon recovery. The apparatus and method of the present invention reduces the amount of land disturbance, such as less earthwork, erosion, and spills. In addition, the present invention reduces the amount of surface facilities required such as tanks, separators, and surface handling equipment. With less and/or smaller surface equipment, there could be fewer leaking valves and connections as well as reduced chemical handling, storage, and use. Through use of the present invention, fewer single-use injection wells and associated facilities, pumps, and injection lines are needed. The present invention can also reduce the need for produced water trucking or transportation. Further, because less water is lifted to the ground surface, the evaporation and exposure of water-soluble hydrocarbons to the atmosphere is minimized. In reservoirs wherein the excess water has a moderate to high hydrogen sulfide content, exposure of the hydrogen sulfide to the surrounding environment may also be minimized or eliminated. Moreover, with less equipment at the ground surface, noise or other air pollution from such equipment may be minimized. Waterfloods or pressure maintenance projects could utilize less fresh water. Fewer spills from corrosion, overflowing tanks, or other equipment failures are other benefits. Further, there is less need for isolated wastewater disposal sites and fewer wellbores penetrating aquifers. Smaller offshore platforms are possible as well.

The present invention can also result in less electrical power and associated costs which allows for more efficient recovery of natural hydrocarbon resources and extended life for marginal wells and fields. The present invention could also provide pressure maintenance or waterflooding as a byproduct of production.

Conclusion

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

We claim:

1. A downhole oil and water separation system for conducting produced fluids, including produced hydrocarbons and a portion of produced water, to a ground surface and injecting, without conducting to the ground surface, the remaining produced water below the ground surface, the system comprising:

a casing having two spaced intervals and extending from the ground surface downwardly such that a first of said two spaced intervals communicates with a producing zone and a second of said two spaced intervals communicates with an injection zone;

a rod-driven progressive cavity pump and an electrical submersible progressive cavity pump disposed in said casing, wherein said rod-driven progressive cavity pump is not drivingly coupled to said electrical submersible progressive cavity pump;

a packer disposed within said casing between said first of said two spaced intervals and said second of said two spaced intervals, wherein said casing and said packer are configured to permit the produced fluids to collect above said packer whereby the produced hydrocarbons and produced water segregate under influence of gravity;

a tubing extending from the ground surface downwardly within said casing;

a branch conduit coupled to said tubing, wherein said electrical submersible progressive cavity pump is disposed in said branch conduit and said rod-driven progressive cavity pump is disposed in said tubing;

a first inlet for permitting the segregated produced hydrocarbons and portion of the produced water to enter said rod-driven progressive cavity pump; and a second inlet for permitting the segregated produced water to enter said electrical submersible progressive cavity pump.

2. A downhole oil and water separation system for conducting produced fluids, including produced hydrocarbons and a portion of produced water, to a ground surface and injecting, without conducting to the ground surface, the remaining produced water below the ground surface, the system comprising:

a casing having two spaced intervals and extending from the ground surface downwardly such that a first of said two spaced intervals communicates with a producing zone so that produced hydrocarbons and produced water enter said casing through said first of said two spaced intervals and a second of said two spaced intervals communicates with an injection zone;

a first electrical submersible progressive cavity pump and a second electrical submersible progressive cavity pump disposed in said casing, wherein said first electrical submersible progressive cavity pump is not drivingly coupled to said second electrical submersible progressive cavity pump;

a packer disposed within said casing between said first of said two spaced intervals and said second of said two spaced intervals, wherein said casing and said packer are configured to permit the produced fluids to collect above said packer whereby the produced hydrocarbons and produced water segregate under influence of gravity;

a tubing extending from the ground surface downwardly within said casing;

a branch conduit coupled to said tubing, wherein said first electrical submersible progressive cavity pump is disposed in said branch conduit and said second electrical submersible progressive cavity pump is disposed in said tubing;

a first inlet for permitting the segregated produced hydrocarbons and portion of the produced water to enter one of said first and second electrical submersible progressive cavity pumps; and a second inlet for permitting the segregated produced water to enter the other of said first and second electrical submersible progressive cavity pumps.

3. A downhole oil and water separation system for conducting produced fluids, including produced hydrocarbons and a portion of produced water, to a ground surface and injecting, without conducting to the ground surface, the remaining produced water below the ground surface, the system comprising:

a casing having two spaced intervals and extending from the ground surface downwardly such that a first of said two spaced intervals communicates with a producing zone and a second of said two spaced intervals communicates with an injection zone;

a rod-driven progressive cavity pump and an electrical submersible progressive cavity pump disposed in said casing, wherein said rod-driven progressive cavity pump is not drivingly coupled to said electrical submersible progressive cavity pump;

a packer disposed within said casing between said first of said two spaced intervals and said second of said two spaced intervals, wherein said casing and said packer are configured to permit the produced fluids to collect above said packer whereby the produced hydrocarbons and produced water segregate under influence of gravity;

a tubing extending from the ground surface downwardly within said casing;

a branch conduit coupled to said tubing, wherein said electrical submersible progressive cavity pump is disposed in said branch conduit and said rod-driven progressive cavity pump is disposed in said tubing;

a first inlet for permitting the segregated produced hydrocarbons and portion of the produced water to enter said electrical submersible progressive cavity pump; and a second inlet for permitting the segregated produced water to enter said rod-driven progressive cavity pump.

4. A downhole oil and water separation system comprising:

a casing having an interval, said casing extending from a ground surface downwardly such that said interval communicates with a producing zone;

a first progressive cavity pump and a second progressive cavity pump disposed in said casing;

a packer disposed within said casing, wherein said casing and said packer are configured to permit produced hydrocarbons and produced water to collect above said packer whereby the produced hydrocarbons and the produced water segregate under influence of gravity;

a tubing extending from the ground surface downwardly within said casing;

a branch conduit coupled to said tubing, wherein said first progressive cavity pump is disposed in said branch conduit and said second progressive cavity pump is coupled to said tubing;

a first inlet for permitting the segregated produced hydrocarbons to enter one of said first progressive cavity pump and said second progressive cavity pump; and a second inlet for permitting the segregated produced water to enter the other of said first progressive cavity pump and said second progressive cavity pump.

5. An apparatus for selectively lifting produced fluids, including produced hydrocarbons and a portion of produced water, to a ground surface and injecting, without lifting to the ground surface, the remaining produced water below the ground surface, the apparatus comprising:

a casing having two spaced intervals and extending from the ground surface downwardly such that a first of said two spaced intervals communicates with a producing zone so that produced hydrocarbons and produced water enter said casing through said first of said two spaced intervals and a second of said two spaced intervals communicates with an injection zone;

a first progressive cavity pump and a second progressive cavity pump disposed in said casing, each of said first and said second progressive cavity pump having a pump output;

a packer disposed within said casing between said first of said two spaced intervals and said second of said two spaced intervals, wherein said casing and said packer are configured to permit the produced fluids to collect above said packer whereby the produced hydrocarbons and produced water segregate under influence of gravity;

a tubing extending from the ground surface downwardly within said casing, wherein said first progressive cavity pump is disposed within said tubing and said second progressive cavity pump is disposed within said tubing below said first progressive cavity pump;

a conduit coupled to said tubing, wherein one of said first and said second progressive cavity pumps is coupled to said conduit;

a first inlet for permitting the segregated produced hydrocarbons and portion of the produced water to enter one of said first progressive cavity pump and said second progressive cavity pump; and a second inlet for permitting the segregated produced water to enter the other of said first progressive cavity pump and said second progressive cavity pump, wherein said first inlet is disposed in said tubing below said first progressive cavity pump and in fluid flow communication therewith and said second inlet is disposed in said tubing above said second progressive cavity pump and in fluid flow communication therewith.

6. An apparatus according to claim 5, wherein said first progressive cavity pump is a rod-driven progressive cavity pump and said second progressive cavity pump is an electrical submersible progressive cavity pump.

7. An apparatus according to claim 5, wherein said first and said second progressive cavity pumps are electrical submersible progressive cavity pumps.

8. An apparatus according to claim 5, further comprising:

a tubing plug disposed in said tubing between said first progressive cavity pump and said second progressive cavity pump.

9. An apparatus according to claim 5, wherein said first progressive cavity pump is coupled to said tubing and said second progressive cavity pump is disposed within said tubing below said first progressive cavity pump.

10. An apparatus according to claim 5, wherein said conduit is a bypass conduit.

11. An apparatus according to claim 10, further comprising a second packer disposed in said casing, wherein said packer and said second packer are configured to isolate the injection zone located above the producing zone.

12. An apparatus according to claim 11, wherein said conduit extends upwardly through said casing and said packer thereby providing a flow path for the segregated produced water into said casing between said packer and said second packer and thereafter into the injection zone.

13. An apparatus according to claim 5, further comprising:

a motor coupled to one of said first and said second progressive cavity pumps for controlling the pump output of said one of said first and said second progressive cavity pumps coupled to said motor.

14. An apparatus according to claim 13, further comprising:

a sucker rod, whereby said sucker rod couples said motor to said one of said first and said second progressive cavity pumps and is configured to impart rotation from said motor to said one of said first and said second progressive cavity pumps.

15. An apparatus according to claim 5, further comprising:

a variable speed drive coupled to said one of said first and said second progressive cavity pumps coupled to said conduit for controlling the output of said one of said first and said second progressive cavity pumps coupled to said conduit.

16. An apparatus according to claim 5, wherein said conduit is a branch conduit.

17. An apparatus according to claim 16, wherein said one of said first and said second progressive cavity pumps is disposed in said conduit and the other of said first and said second progressive cavity pumps is disposed in said tubing.

18. An apparatus according to claim 17, wherein said first inlet is disposed in said conduit and is in fluid flow communication with said one of said first and said second progressive cavity pumps disposed in said conduit and said second inlet is disposed in said tubing above the other of said first and said second progressive cavity pumps disposed in said tubing and is in fluid flow communication therewith.

19. An apparatus according to claim 16, further comprising:

a tubing plug disposed in said tubing between said first progressive cavity pump and said second progressive cavity pump.

20. An apparatus according to claim 16, wherein said one of said first and said second progressive cavity pump is disposed in said conduit and the other of said first and said second progressive cavity pump is coupled to said tubing.

21. An apparatus according to claim 5, wherein the pump output of said first progressive cavity pump and said second progressive cavity pump are separately controllable.

22. An apparatus according to claim 5, wherein said first progressive cavity pump is not drivingly coupled to said second progressive cavity pump.

23. An apparatus according to claim 5, further comprising:

a second packer, wherein said first packer and said second packer are configured to isolate the injection zone located above the producing zone.

24. An apparatus for selectively lifting produced fluids, including produced hydrocarbons and a portion of produced water, to a ground surface and injecting, without lifting to the ground surface, the remaining produced water below the ground surface, the apparatus comprising:

a casing having two spaced intervals and extending from the ground surface downwardly such that a first of said two spaced intervals communicates with a producing zone so that produced hydrocarbons and produced water enter said casing through said first of said two spaced intervals and a second of said two spaced intervals communicates with an injection zone;

a first progressive cavity pump and a second progressive cavity pump disposed in said casing, each of said first and said second progressive cavity pump having a pump output;

a first packer disposed within said casing between said first of said two spaced intervals and said second of said two spaced intervals, wherein said casing and said first packer are configured to permit the produced fluids to collect above said first packer whereby the produced hydrocarbons and produced water segregate under influence of gravity;

a second packer disposed in said casing;

a bypass conduit coupled to one of said first and said second progressive cavity pump and extending upwardly through said casing and said first packer;

a first inlet for permitting the segregated produced hydrocarbons and portion of the produced water to enter one of said first progressive cavity pump and said second progressive cavity pump; and a second inlet for permitting the segregated produced water to enter the other of said first progressive cavity pump and said second progressive cavity pump.

25. An apparatus for selectively lifting produced fluids, including produced hydrocarbons and a portion of produced water, to a ground surface and injecting, without lifting to the ground surface, the remaining produced water below the ground surface, the apparatus comprising:

a casing having two spaced intervals and extending from the ground surface downwardly such that a first of said two spaced intervals communicates with a producing zone so that produced hydrocarbons and produced water enter said casing through said first of said two spaced intervals and a second of said two spaced intervals communicates with an injection zone;

a first progressive cavity pump and a second progressive cavity pump disposed in said casing, each of said first progressive cavity pump and said second progressive cavity pump having a pump output, and wherein said first progressive cavity pump is not drivingly coupled to said second progressive cavity pump;

a packer disposed within said casing between said first of said two spaced intervals and said second of said two spaced intervals, wherein said casing and said packer are configured to permit the produced fluids to collect above said packer whereby the produced hydrocarbons and produced water segregate under influence of gravity;

a tubing extending from the ground surface downwardly within said casing;

a branch conduit coupled to said tubing, wherein said first progressive cavity pump is disposed in said branch conduit and said second progressive cavity pump is disposed in said tubing;

a first inlet for permitting the segregated produced hydrocarbons and portion of the produced water to enter one of said first progressive cavity pump and said second progressive cavity pump; and a second inlet for permitting the segregated produced water to enter the other of said first progressive cavity pump and said second progressive cavity pump.

26. An apparatus for selectively lifting produced fluids, including produced hydrocarbons and a portion of produced water, to a ground surface and injecting, without lifting to the ground surface, the remaining produced water below the ground surface, the apparatus comprising:

a casing having two spaced intervals and extending from the ground surface downwardly such that a first of said two spaced intervals communicates with a producing zone so that produced hydrocarbons and produced water enter said casing through said first of said two spaced intervals and a second of said two spaced intervals communicates with an injection zone;

a first progressive cavity pump and a second progressive cavity pump disposed in said casing, each of said first progressive cavity pump and said second progressive cavity pump having a pump output, and wherein said first progressive cavity pump is not drivingly coupled to said second progressive cavity pump;

a packer disposed within said casing between said first of said two spaced intervals and said second of said two spaced intervals, wherein said casing and said packer are configured to permit the produced fluids to collect above said packer whereby the produced hydrocarbons and produced water segregate under influence of gravity;

a tubing extending from the ground surface downwardly within said casing;

a branch conduit coupled to said tubing, wherein said first progressive cavity pump is disposed in said branch conduit and said second progressive cavity pump is coupled to said tubing;

a first inlet for permitting the segregated produced hydrocarbons and portion of the produced water to enter one of said first progressive cavity pump and said second progressive cavity pump; and a second inlet for permitting the segregated produced water to enter the other of said first progressive cavity pump and said second progressive cavity pump.

27. An apparatus according to claim 25 or 26, wherein said first progressive cavity pump is a rod-driven progressive cavity pump and said second progressive cavity pump is an electrical submersible progressive cavity pump.

28. A An apparatus according to claim 27, wherein said rod-driven progressive cavity pump is disposed within said tubing and said electrical submersible progressive cavity pump is disposed within said tubing below said rod-driven progressive cavity pump.

29. An apparatus according to claim 28, wherein said first inlet is disposed in said tubing below said rod-driven progressive cavity pump and in fluid flow communication therewith and said second inlet is disposed in said tubing above said electrical submersible progressive cavity pump and in fluid flow communication therewith.

30. An apparatus according to claim 28, further comprising:

a tubing plug disposed in said tubing between said rod-driven progressive cavity pump and said electrical submersible progressive cavity pump.

31. An apparatus according to claim 27, wherein said rod-driven progressive cavity pump is coupled to said tubing and said electrical submersible progressive cavity pump is disposed within said tubing below said rod-driven progressive cavity pump.

32. An apparatus according to claim 27, further comprising:

a second packer disposed in said casing, wherein said packer and said second packer are configured to isolate the injection zone located above the producing zone.

33. An apparatus according to claim 32, further comprising:

a bypass conduit coupled to said electrical submersible progressive cavity pump and extending upwardly through said casing and said packer thereby providing a flow path for the segregated produced water into said casing between said packer and said second packer and hereafter into the injection zone.

34. An apparatus according to claim 27, further comprising:

a motor coupled to said rod-driven progressive cavity pump for controlling the pump output of said rod-driven progressive cavity pump.

35. An apparatus according to claim 34, further comprising:

a sucker rod, whereby said sucker rod couples said motor to said rod-driven progressive cavity pump and is configured to impart rotation from said motor to said rod-driven progressive cavity pump.

36. An apparatus according to claim 27, further comprising:

a variable speed drive coupled to said electrical submersible progressive cavity pump for controlling the pump output of said electrical submersible progressive cavity pump.

37. An apparatus according to claim 27, wherein said first inlet is disposed in said branch conduit and is in fluid flow communication with said electrical submersible progressive cavity pump and said second inlet is disposed in said tubing above said rod-driven progressive cavity pump and is in fluid flow communication therewith.

38. An apparatus according to claim 27, further comprising:

a tubing plug disposed in said tubing between said rod-driven progressive cavity pump and said electrical submersible progressive cavity pump.

39. An apparatus according to claim 27, wherein the pump output of said rod-driven progressive cavity pump and said electrical submersible progressive cavity pump may be separately controlled.

40. An apparatus according to claim 27, wherein said rod-driven progressive cavity pump is not drivingly coupled to said electrical submersible progressive cavity pump.

41. An apparatus according to claim 25 or 26, wherein said first and said second progressive cavity pumps are electrical submersible progressive cavity pumps.

42. A downhole oil and water separation system for conducting produced fluids, including produced hydrocarbons and a portion of produced water, to a ground surface and injecting, without conducting to the ground surface, the remaining produced water below the ground surface, the system comprising:

a casing having two spaced intervals and extending from the ground surface downwardly such that a first of said two spaced intervals communicates with a producing zone and a second of said two spaced intervals communicates with an injection zone;

a rod-driven progressive cavity pump and an electrical submersible progressive cavity pump disposed in said casing, wherein said rod-driven progressive cavity pump is not drivingly coupled to said electrical submersible progressive cavity pump;

a packer disposed within said casing between said first of said two spaced intervals and said second of said two spaced intervals, wherein said casing and said packer are configured to permit the produced fluids to collect above said packer whereby the produced hydrocarbons and produced water segregate under influence of gravity;

a tubing extending from the ground surface downwardly within said casing;

a branch conduit coupled to said tubing, wherein said electrical submersible progressive cavity pump is disposed in said branch conduit and said rod-driven progressive cavity pump is coupled to said tubing;

a first inlet for permitting the segregated produced hydrocarbons and portion of the produced water to enter said rod-driven progressive cavity pump; and a second inlet for permitting the segregated produced water to enter said electrical submersible progressive cavity pump.

43. A downhole oil and water separation system for conducting produced fluids, including produced hydrocarbons and a portion of produced water, to a ground surface and injecting, without conducting to the ground surface, the remaining produced water below the ground surface, the system comprising:

a casing having two spaced intervals and extending from the ground surface downwardly such that a first of said two spaced intervals communicates with a producing zone so that produced hydrocarbons and produced water enter said casing through said first of said two spaced intervals and a second of said two spaced intervals communicates with an injection zone;

a first electrical submersible progressive cavity pump and a second electrical submersible progressive cavity pump disposed in said casing, wherein said first electrical submersible progressive cavity pump is not drivingly coupled to said second electrical submersible progressive cavity pump;

a packer disposed within said casing between said first of said two spaced intervals and said second of said two spaced intervals, wherein said casing and said packer are configured to permit the produced fluids to collect above said packer whereby the produced hydrocarbons and produced water segregate under influence of gravity;

a tubing extending from the ground surface downwardly within said casing;

a branch conduit coupled to said tubing, wherein said first electrical submersible progressive cavity pump is disposed in said branch conduit and said second electrical submersible progressive cavity pump is coupled to said tubing;

a first inlet for permitting the segregated produced hydrocarbons and portion of the produced water to enter one of said first and second electrical submersible progressive cavity pumps; and a second inlet for permitting the segregated produced water to enter the other of said first and second electrical submersible progressive cavity pumps.

44. A downhole oil and water separation system for conducting produced fluids, including produced hydrocarbons and a portion of produced water, to a ground surface and injecting, without conducting to the ground surface, the remaining produced water below the ground surface, the system comprising:

a casing having two spaced intervals and extending from the ground surface downwardly such that a first of said two spaced intervals communicates with a producing zone and a second of said two spaced intervals communicates with an injection zone;

a rod-driven progressive cavity pump and an electrical submersible progressive cavity pump disposed in said casing, wherein said rod-driven progressive cavity pump is not drivingly coupled to said electrical submersible progressive cavity pump;

a packer disposed within said casing between said first of said two spaced intervals and said second of said two spaced intervals, wherein said casing and said packer are configured to permit the produced fluids to collect above said packer whereby the produced hydrocarbons and produced water segregate under influence of gravity;

a tubing extending from the ground surface downwardly within said casing;

a branch conduit coupled to said tubing, wherein said electrical submersible progressive cavity pump is disposed in said branch conduit and said rod-driven progressive cavity pump is coupled to said tubing;

a first inlet for permitting the segregated produced hydrocarbons and portion of the produced water to enter said electrical submersible progressive cavity pump; and a second inlet for permitting the segregated produced water to enter said rod-driven progressive cavity pump.

* * * * *